US005971192A

United States Patent [19]

Immerman et al.

[11] Patent Number: 5,971,192

[45] Date of Patent: Oct. 26, 1999

[54] BATHROOM ACCESSORIES

[75] Inventors: Robert A. Immerman, Shaker Heights; James Hampshire, Solon, both of Ohio

[73] Assignee: InterDesign, Inc., Solon, Ohio

[21] Appl. No.: 08/579,665

[22] Filed: Dec. 27, 1995

[51] Int. Cl.[6] ..... B65D 1/00

[52] U.S. Cl. ..... 220/483; 220/676; 220/DIG. 13; 220/DIG. 6; 206/771; 211/88

[58] Field of Search ..... 220/483, DIG. 13, 220/DIG. 6; 206/77.1; 211/88

[56] References Cited

U.S. PATENT DOCUMENTS

| | | | |
|---|---|---|---|
| D. 176,842 | 2/1956 | D'Ath | D4/3 |
| D. 223,049 | 3/1972 | Brooks | D52/2 |
| D. 233,203 | 10/1974 | Hughes | D7/46 |
| D. 287,172 | 12/1986 | Fulanovich | D32/41 |
| D. 318,157 | 7/1991 | Perior | D32/41 |
| D. 327,146 | 6/1992 | Miller | D32/42 |
| D. 340,373 | 10/1993 | Konkin | D6/518 |
| D. 343,265 | 1/1994 | Pollak et al. | D32/41 |
| 479,092 | 7/1882 | Julian . | |
| 570,666 | 11/1896 | Huebel | 206/77.1 |
| 757,645 | 4/1904 | Bassett | 220/DIG. 13 |
| 1,219,370 | 3/1917 | Bray | 206/77.1 |
| 1,739,801 | 12/1929 | Pitts | 220/483 |
| 1,889,242 | 2/1932 | McNab . | |
| 1,913,806 | 6/1933 | High | 220/482 |
| 1,984,610 | 12/1934 | Warren | 221/60 |
| 2,009,721 | 7/1935 | Williams | 224/29 |
| 2,042,548 | 6/1936 | Peters | 248/350 |
| 2,155,341 | 4/1939 | Wayne | 248/362 |
| 2,200,902 | 5/1940 | Solomon | 228/62 |
| 2,271,769 | 2/1942 | Kieft | 248/206 |
| 2,319,726 | 5/1943 | Duggan | 248/206 |
| 2,457,918 | 1/1949 | Pierce | 206/77.1 |
| 2,542,400 | 2/1951 | Donofrio | 65/15 |
| 2,620,082 | 12/1952 | Harmon | 220/476 |
| 2,641,415 | 6/1953 | Moriarty | 242/55.2 |
| 2,642,248 | 6/1953 | Semon | 248/206 |
| 2,665,872 | 1/1954 | DeWitt | 248/362 |
| 2,711,765 | 6/1955 | Pecoraro | 146/216 |
| 2,717,717 | 9/1955 | Busch | 220/483 |
| 2,739,632 | 3/1956 | Rodriguez | 150/2.1 |
| 2,839,260 | 6/1958 | Jacobi, Jr. | 248/146 |
| 2,854,134 | 9/1958 | Humphrey | 206/57 |
| 2,969,890 | 1/1961 | Udell | 220/69 |
| 3,079,099 | 2/1963 | Blain | 242/55.2 |
| 3,539,124 | 11/1970 | Belokin, Jr. | 242/55.54 |
| 3,623,641 | 11/1971 | Hansen et al. | 222/105 |
| 3,665,943 | 5/1972 | Lampman et al. | 220/676 |
| 3,713,188 | 1/1973 | Holladay | 17/70 |
| 4,012,007 | 3/1977 | Cunningham | 242/55.54 |
| 4,157,762 | 6/1979 | Robinson | 220/DIG. 13 |
| 4,565,335 | 1/1986 | Rankin | 242/55.2 |
| 4,934,640 | 6/1990 | Bichon | 206/77.1 |
| 4,951,533 | 8/1990 | Hillinger | 81/177.1 |
| 4,977,637 | 12/1990 | Demers | 15/104 R |
| 5,236,387 | 8/1993 | Simon | 452/194 |
| 5,241,714 | 9/1993 | Barry | 4/605 |
| 5,326,086 | 7/1994 | Radencic | 269/54.5 |
| 5,397,750 | 3/1994 | Hunt | 242/55.54 |

FOREIGN PATENT DOCUMENTS

| | | | |
|---|---|---|---|
| 811949 | of 0000 | United Kingdom . | |
| 397172 | 8/1933 | United Kingdom | 220/484 |

*Primary Examiner*—Joseph M. Moy
*Attorney, Agent, or Firm*—D. Peter Hochberg

[57] ABSTRACT

A bathroom accessory mountable to a generally vertical flat surface such as glass, mirror, tile, fiberglass or metal. The bathroom accessory makes efficient use of space available in a bathroom.

2 Claims, 16 Drawing Sheets

BATHROOM ACCESSORIES

FIELD OF THE INVENTION

The present invention relates generally to bathroom accessories, and more particularly, to bathroom accessories securable to a bathroom wall.

BACKGROUND OF THE INVENTION

A typical household bathroom is a small and confined place. Accordingly, there is a limited amount of available storage space for items needed while in the bathroom. As a result, most household bathrooms quickly become disorganized and cluttered, making it difficult, time-consuming and inconvenient to locate items that are needed while in the bathroom. Moreover, the bathroom becomes increasingly difficult to maintain and clean.

The present invention overcomes these and other drawbacks and provides accessories which can be conveniently stored in a bathroom and which allow for efficient use of existing bathroom space.

SUMMARY OF THE INVENTION

According to the present invention, there is provided a bathroom accessory securable to a generally vertical surface. The accessory comprises a wall member locatable adjacent to the generally vertical surface to which the accessory is to be secured, and one or more suction cups engageable with the wall member for securing the accessory to the generally vertical surface. The suction cups have a head portion attachable to the wall member and a resilient, concave member having a circular projection. The suction cups are compressable against the generally vertical surface to secure the bathroom accessory to the generally vertical surface. The bathroom accessory is made of plastic and has a weight of at least 3.5 ounces, without the suction cups, and has a wall member having a maximum width of at least 6 inches.

According to another aspect of the present invention, there is provided a squeegee member comprising a generally longitudinal handle portion, a generally longitudinal arm portion attached to the handle portion to form a T-shaped holding member, a wiper blade attached to and extending from the arm portion, and a suction cup attached to the handle for being pressed against a generally vertical surface to releasably secure the squeegee member to the generally vertical surface.

It is an object of the present invention to provide bathroom accessories which make efficient use of space available in a bathroom.

It is another object of the present invention to provide bathroom accessories which are suitable for use inside a shower.

It is another object of the present invention to provide bathroom accessories which can be conveniently relocated within a bathroom.

It is another object of the present invention to provide a squeegee member which is engageable with a generally vertical surface.

It is another object of the present invention to provide a squeegee member which can be conveniently stored without the use of a hook.

It is another object of the present invention to provide a shower basket for holding various bathroom items, which is conveniently securable to a generally vertical surface.

It is still another object of the present invention to provide a shower and tub caddy which is conveniently securable to a generally vertical surface.

It is still another object of the present invention to provide a shower and tub organizer which is conveniently securable to a generally vertical surface.

It is yet another object of the present invention to provide a corner shelf which is conveniently securable to a generally vertical surface.

It is yet another object of the present invention to provide a toothbrush storage unit which is conveniently securable to a generally vertical surface.

These and other objects will become apparent from the following description of preferred embodiments of the present invention taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENT

Figure 1:
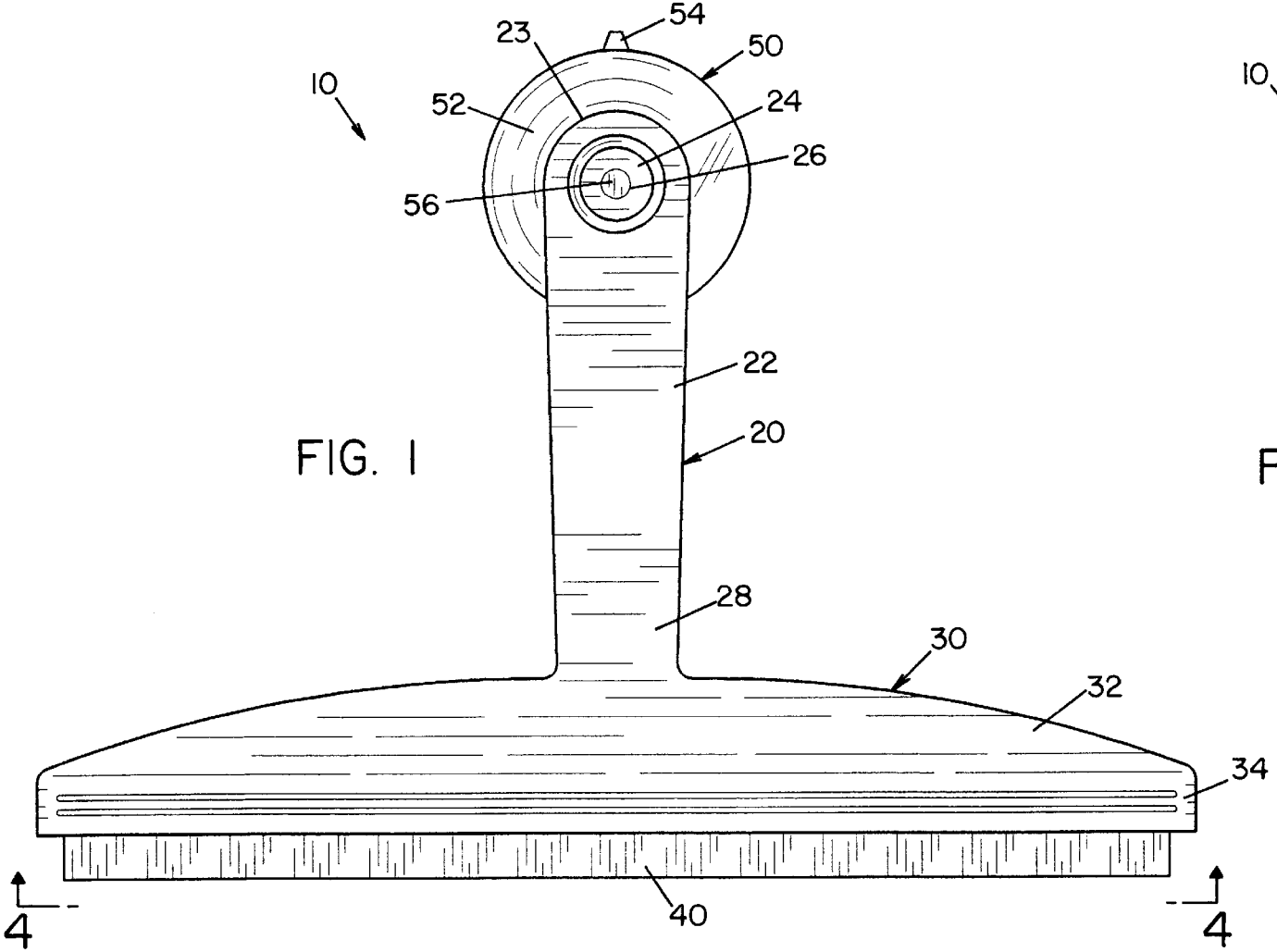
FIG. 1 is a front plan view of a squeegee member illustrating a preferred embodiment of the present invention.

Referring now to the drawings wherein the showing is for the purpose of illustrating preferred embodiments of the invention only, and not for the purpose of limiting same, FIGS. 1–4 show a T-shaped squeegee 10 according a preferred embodiment of the present invention. Squeegee 10 is generally comprised of handle portion 20, an arm portion 30, and a wiper blade 40. Handle portion 20 is comprised of a generally planar elongated upper section 22 and a generally planar lower section 28. Upper section 22 and lower section 28 are at a slight angle relative to each other (see FIG. 2). Upper section 22 includes an annular depression 24, as best seen in FIG. 1. A hole 26 is provided at the center of annular depression 24, the hole dimensioned to receive suction cup 50, which will be discussed in greater detail below. It will be appreciated that annular depression 24 is formed on both the front side of upper section 22 shown in FIG. 1, as well as the rear side of upper section 22 shown in FIG. 3. Annular depressions 24 reduce the depth of hole 26. In addition, upper section 22 has a curved top 23.

Figure 2:
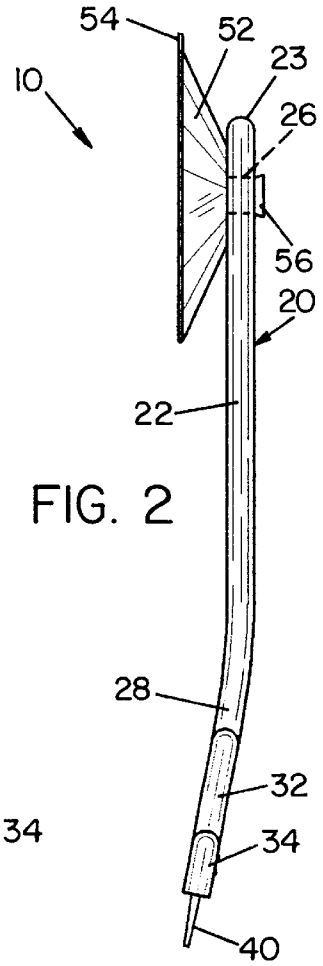
FIG. 2 is a side plan view of the squeegee shown in FIG. 1.
Figure 3:
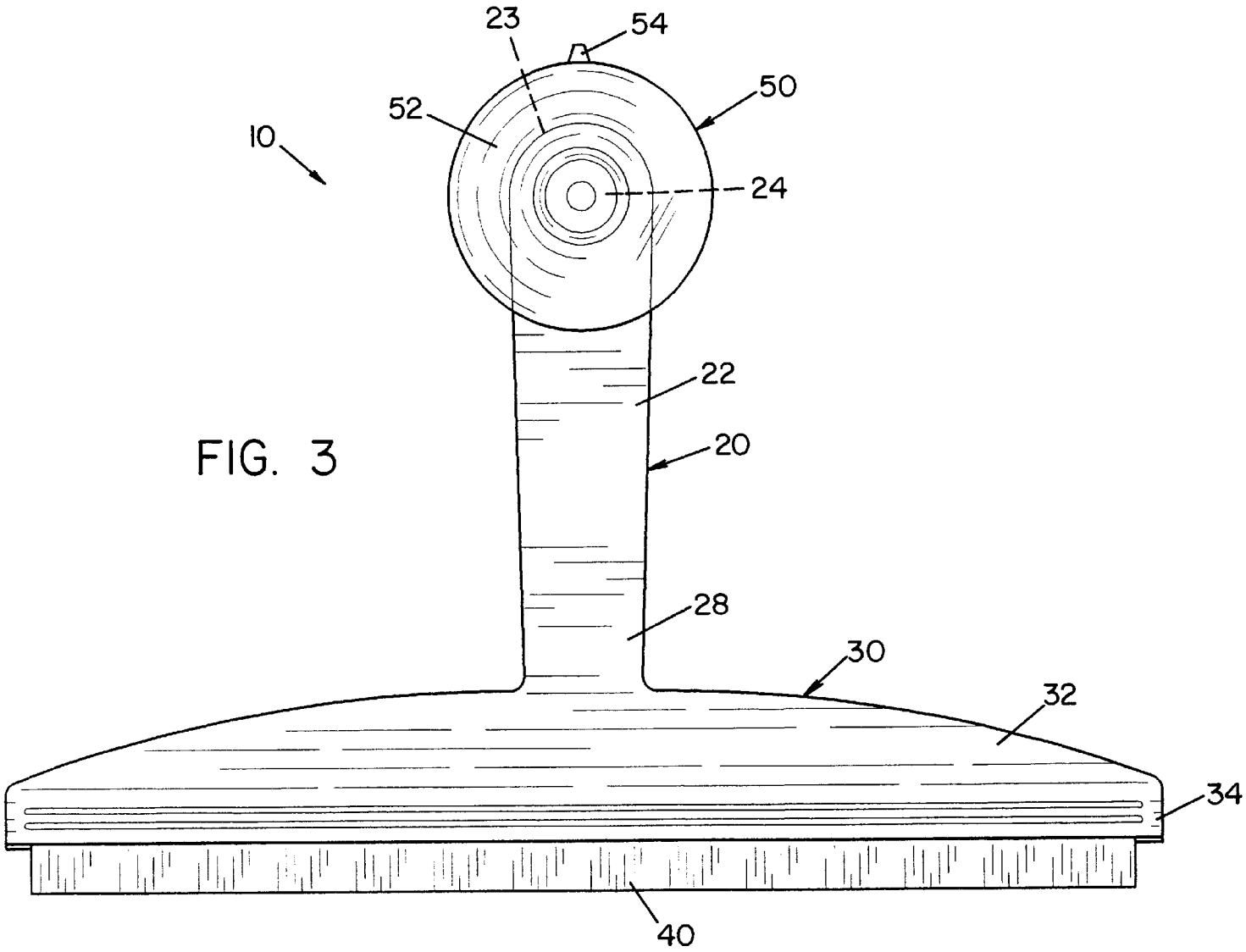
FIG. 3 is a rear plan view of the squeegee shown in FIG. 1.
Figure 4:
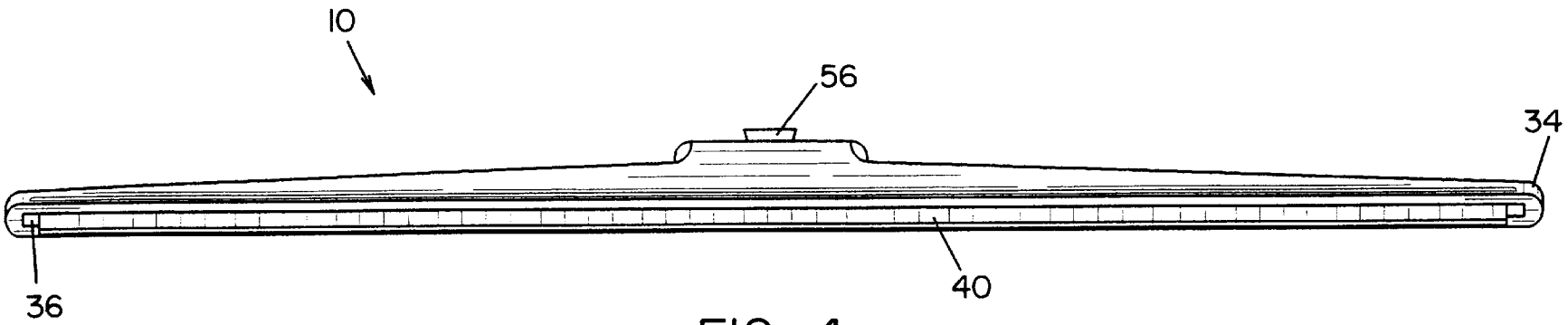
FIG. 4 is an end plan view taken along line 4—4 of FIG. 1.

Lower section 28 extends between upper section 22 and arm portion 30. While lower section 28 is generally coplanar with arm 30, it is at a slight angle relative to upper section 22, as best seen in FIG. 2. Furthermore, as shown in FIGS. 1 and 3, handle portion 20 tapers from the top of upper section 22 to the bottom of lower section 28.

Arm portion 30 is comprised of an arched section 32 and a rectangular blade-receiving section 34. Arm portion 30 extends transversely to handle portion 20. Blade-receiving section 34 includes a slot 36 for receiving a wiper blade 40 (see FIG. 4).

Suction cup 50 is a conventional suction cup used to support squeegee member 10 on a generally vertical surface. The vertical surface is preferably a smooth flat surface such as glass, mirror (e.g., a bathroom mirror), tile (e.g., a bathroom wall), fiberglass, or metal.

Suction cup 50 is comprised of a concave member 52 and a head 56. Concave member 52 includes a tab 54. By lifting and pulling tab 54, suction cup 50 can be easily removed from a vertical surface. Concave member 52 has a diameter of approximately 2¾ inches. Head 56 has a generally cylindrical shape and has a length sufficient to extend through hole 26 of handle portion 20. Head 56 has a diameter dimensioned to be receivable by hole 26 of handle portion 20. Handle portion 20 is removable from suction cup 50 by disengaging hole 26 from head 56. Accordingly, squeegee member 10 can be removed from suction cup 50 during use, and returned thereto for convenient storage.

The preferred dimensions in each of two sizes of squeegee member 10 will now be described. In the smaller version of squeegee member 10, handle portion 20 has a length of approximately 6 inches and a width of approximately 1½ inches; arm portion 30 has a length of approximately 1½ inches, and a width of approximately 8 inches; wiper blade 40 has a length of approximately 1 inch and a width of approximately 8 inches. However, it should be noted that only approximately ½ inch of wiper blade 40 extends outward from slot 36. The total weight of the smaller version of squeegee member 10, not including suction cup 50, is about 3.5 ounces. In its larger version, squeegee member 10 has a handle portion 20 of a length of approximately 6 inches and a width of approximately 1½ inches; its arm portion 30 has a length of approximately 1½ inches and a width of approximately 12 inches. Blade 40 has a width of approximately 1 inch and a width of approximately 12 inches. The other dimensions are the same for both the small and large versions of squeegee member 10. The weight for the larger squeegee member 10 without the suction cups is about 4.0 ounces. Squeegee member 10 is preferably constructed of plastic.

Squeegee member 10 has a variety of uses, including the removal of water and fog from glass or mirrored surfaces.

Figure 5:
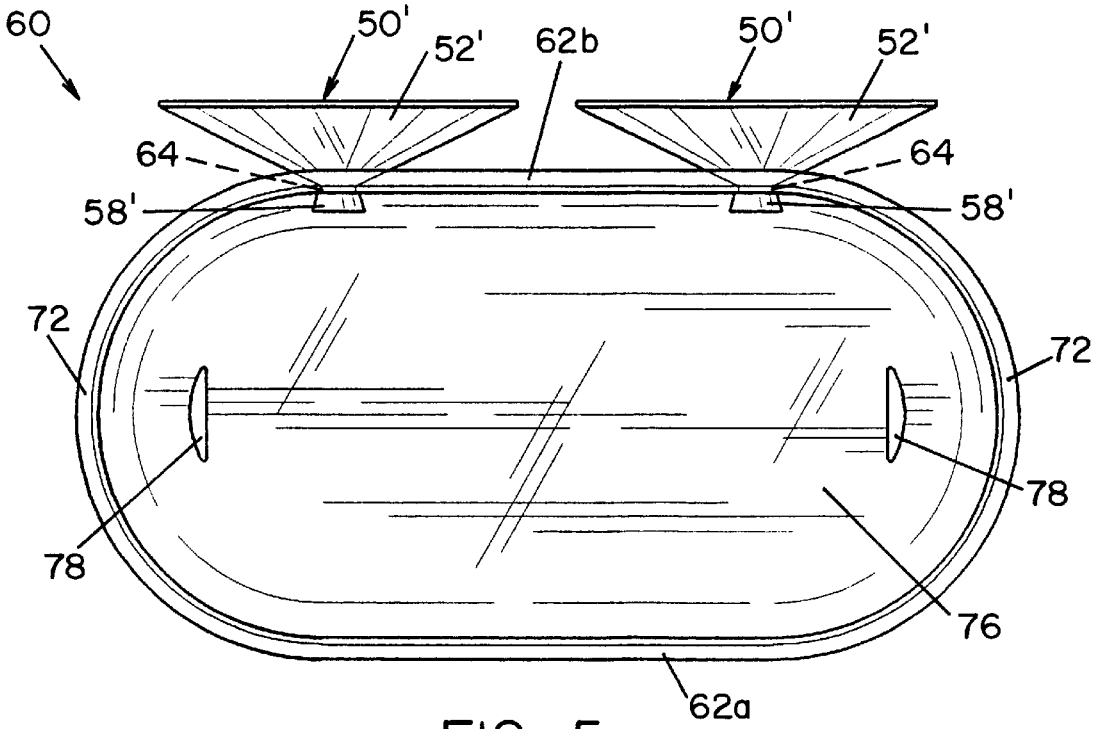
FIG. 5 is a top plan view of a basket illustrating another preferred embodiment of the present invention.
Figure 6:
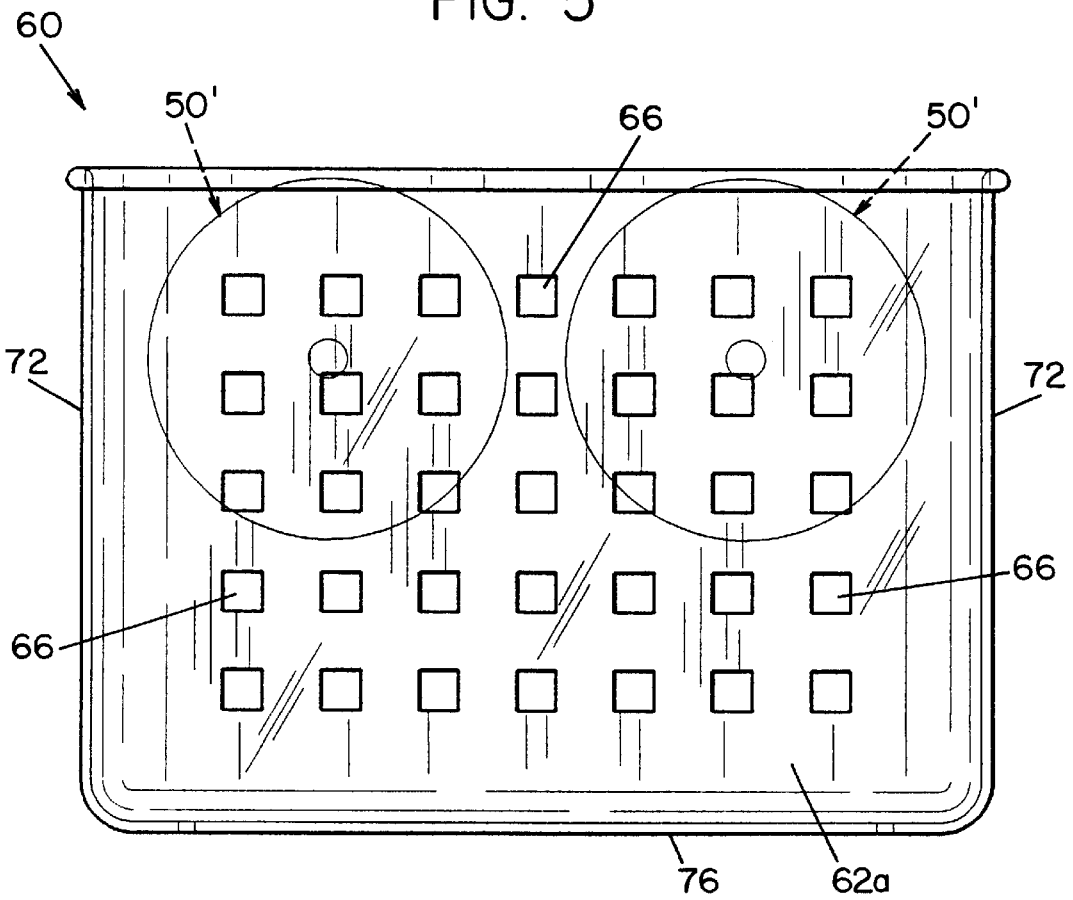
FIG. 6 is a front plan view of the basket shown in FIG. 5.
Figure 7:
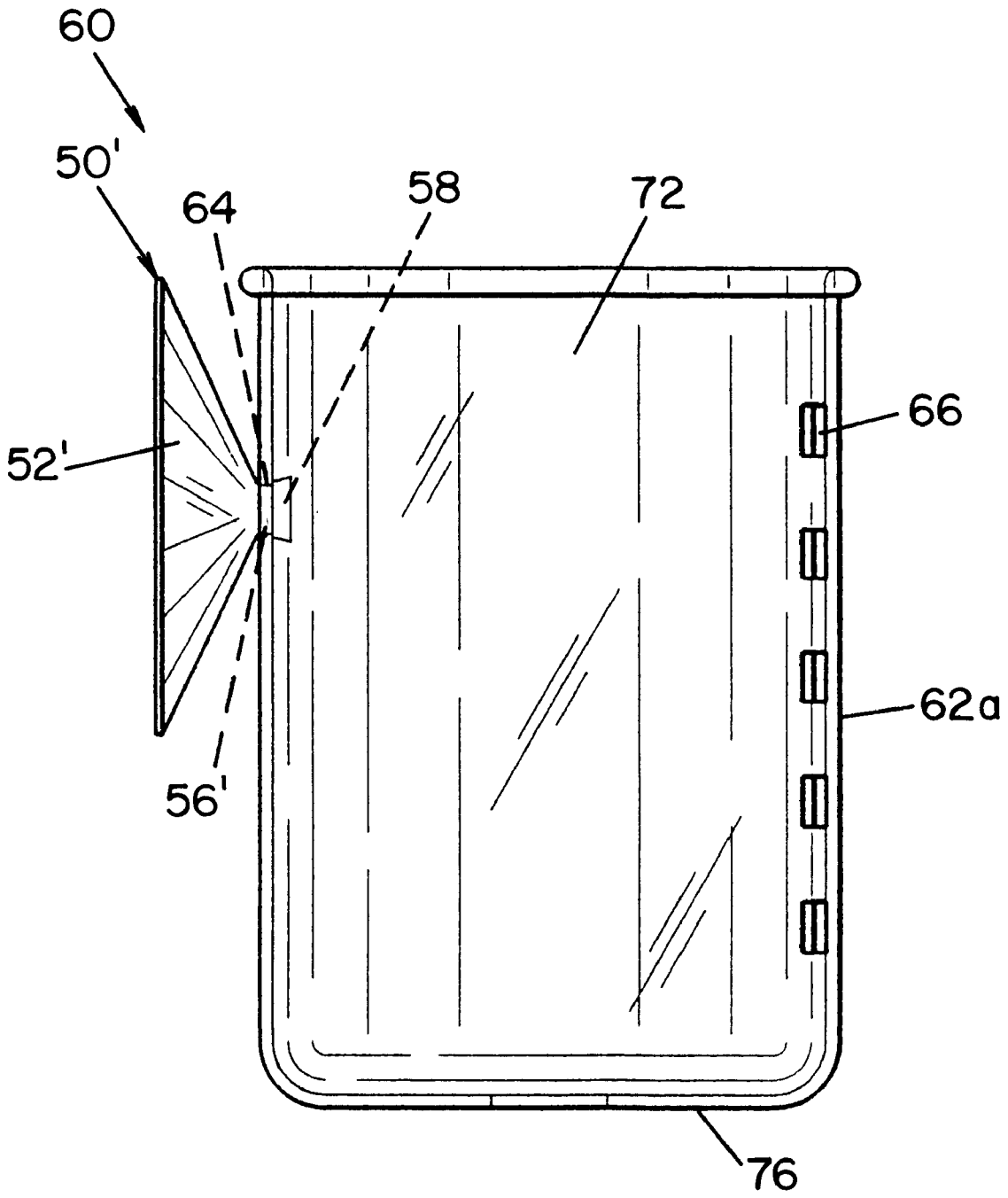
FIG. 7 is a side plan view of the basket shown in FIG. 5.
Figure 8:
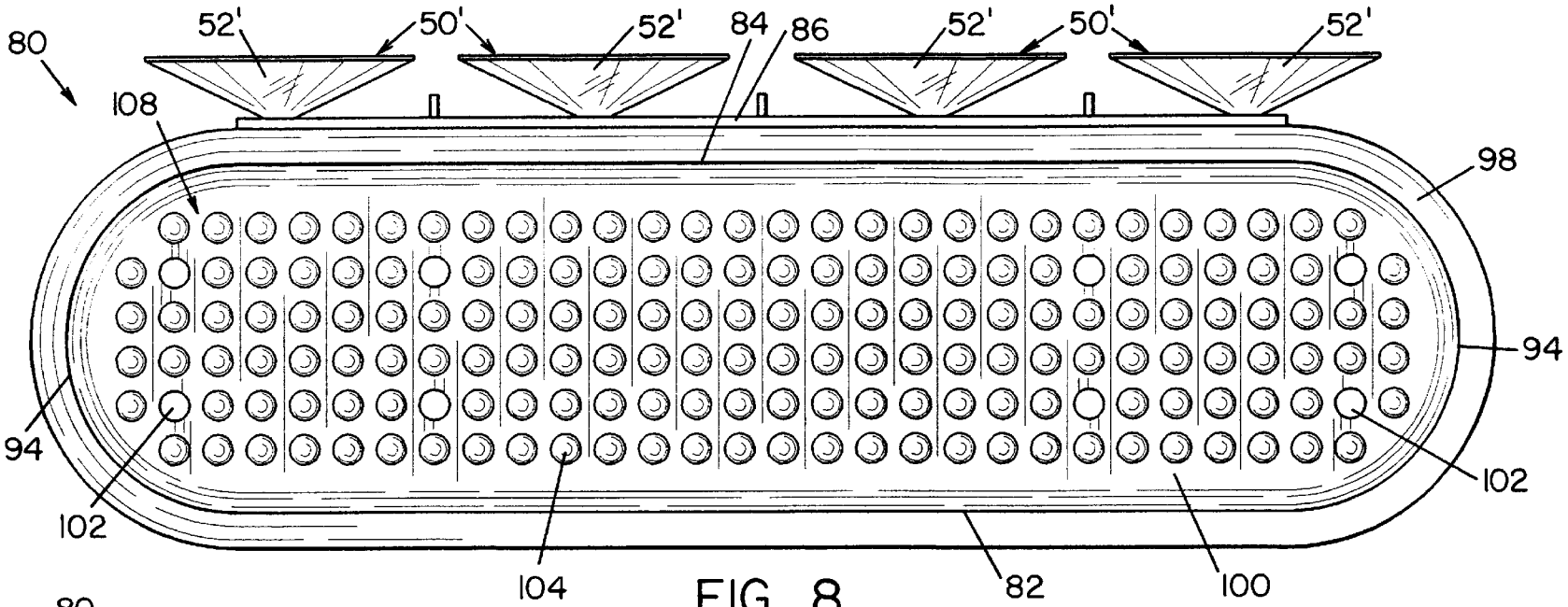
FIG. 8 is a top plan view of a first tray illustrating another preferred embodiment of the present invention.
Figure 9:
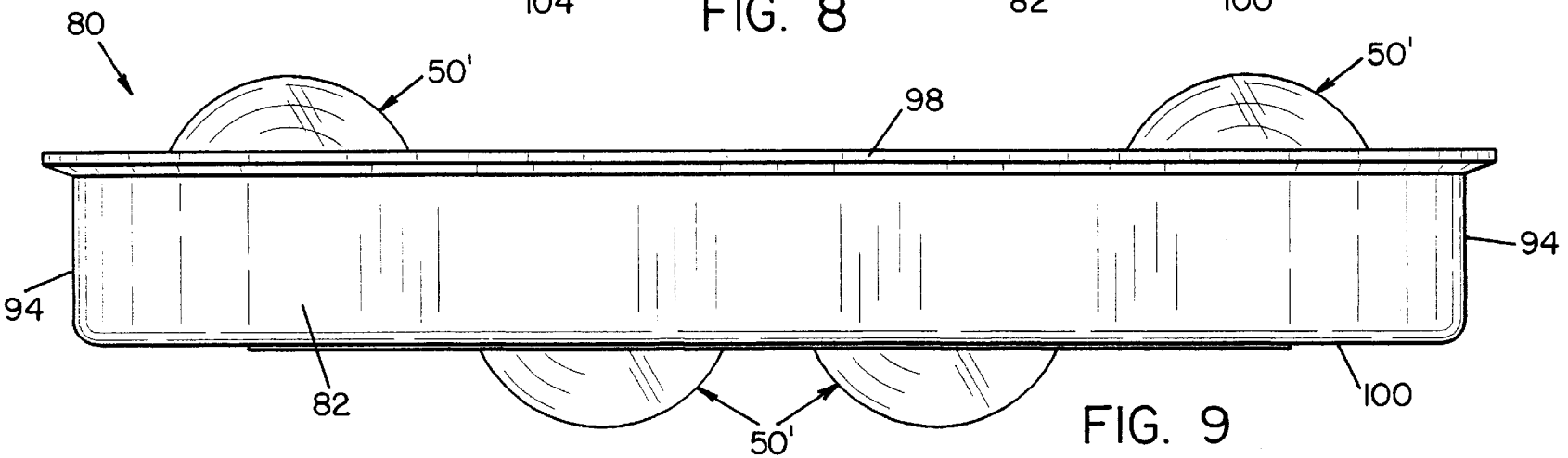
FIG. 9 is a front plan view of the tray shown in FIG. 8.

Referring now to FIGS. 5–7, there is shown a basket 60, particularly suitable for use as a shower basket for storage of items, such as shampoo, conditioner, soap and sponges. Basket 60 is generally comprised of a front side wall 62*a*, rear side wall 62*b*, end walls 72, and a floor 76. Front side wall 62*a* includes a plurality of apertures 66. Apertures 66 allow water to drain from basket 60, and allow items stored inside basket 60 to be identified. Rear side wall 62*b* includes a plurality of holes 64. Holes 64 are dimensioned to receive a suction cup 50', which is similar to suction cup 50 described above. Suction cup 50' is generally comprised of a concave member 52' and a head 56'. Concave member 52' is the same as concave member 52, except it lacks the optimal tab 54. Head 56' is similar to head 56', but includes a locking portion 58' at the end of heat 56' opposite concave member 52'. Locking portion 58' has a diameter greater than the other parts of head 56'. Accordingly, locking portion 58' engages with the inner surface of rear side wall 62*b* to secure suction cup 50 to basket 60. Accordingly, if basket 60 is removed from a flat surface to which it is attached, basket 60 will not become separated from suction cup 50'. Furthermore, the force exerted to remove basket 60 will also remove suction cup 50 from the flat surface. Therefore, tab 54 is not required.

End walls 72 are generally U-shaped and connect side walls 62*a* and 62*b*. A rim 75 is formed along the upper perimeter of walls 62*a*, 62*b* and 72. Floor 76 includes drainage apertures 78 which allow fluid to drain out from the interior of basket 60.

It will be appreciated that basket 60 is mountable to a generally vertical surface using suction cups 50', the surface preferably being a smooth flat surface, such as glass, mirror, tile, fiberglass or metal.

The preferred dimensions of basket 60 will now be described. Side walls 62*a* and 62*b* have a width of approximately 6¾ inches and a height of approximately 6 inches; end walls 72 have a width of approximately 3½ inches and a height of approximately 6 inches. The interior dimensions of basket 60 are approximately 10 inches×3 inches×6 inches. The total weight of basket 60, excluding the weight of suction cups 50', is approximately 11 ounces. Basket 60 is preferably constructed of plastic.

Referring now to FIGS. 8–11, there is shown a tray 80, particularly suitable for use as a shower and tub caddy, for storing items such as shampoo, conditioner, soap and sponges. Tray 80 is generally comprised of a front side wall 82, a rear side wall 84, an engagement wall 86, and a floor 100. End walls 94 are generally U-shaped and connect front side wall 82 to rear side wall 84. A rim or lip 98 is arranged along the upper perimeter of front side wall 82, rear side wall 84 and end walls 94.

Figure 10:
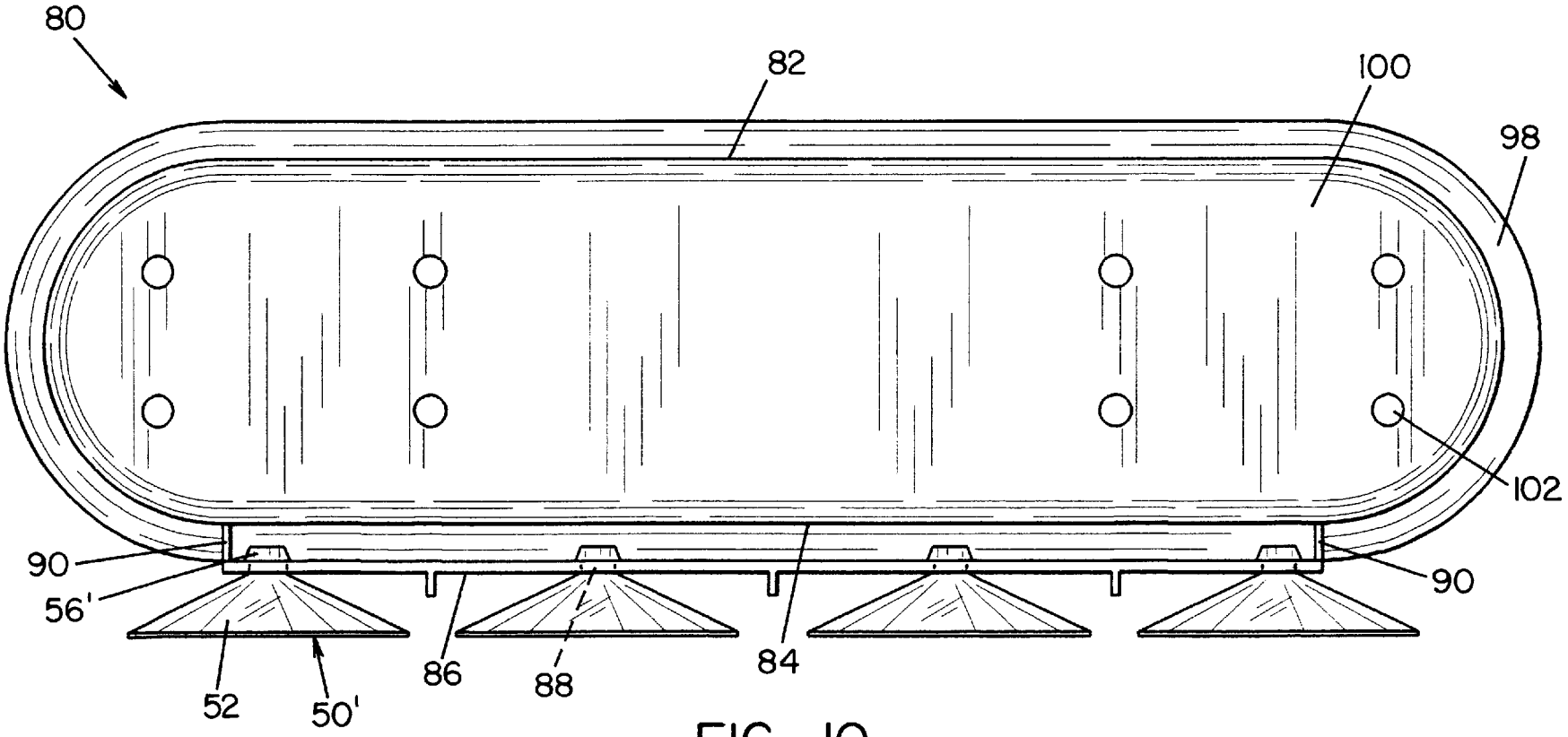
FIG. 10 is a bottom plan view of the tray shown in FIG. 8.
Figure 11:
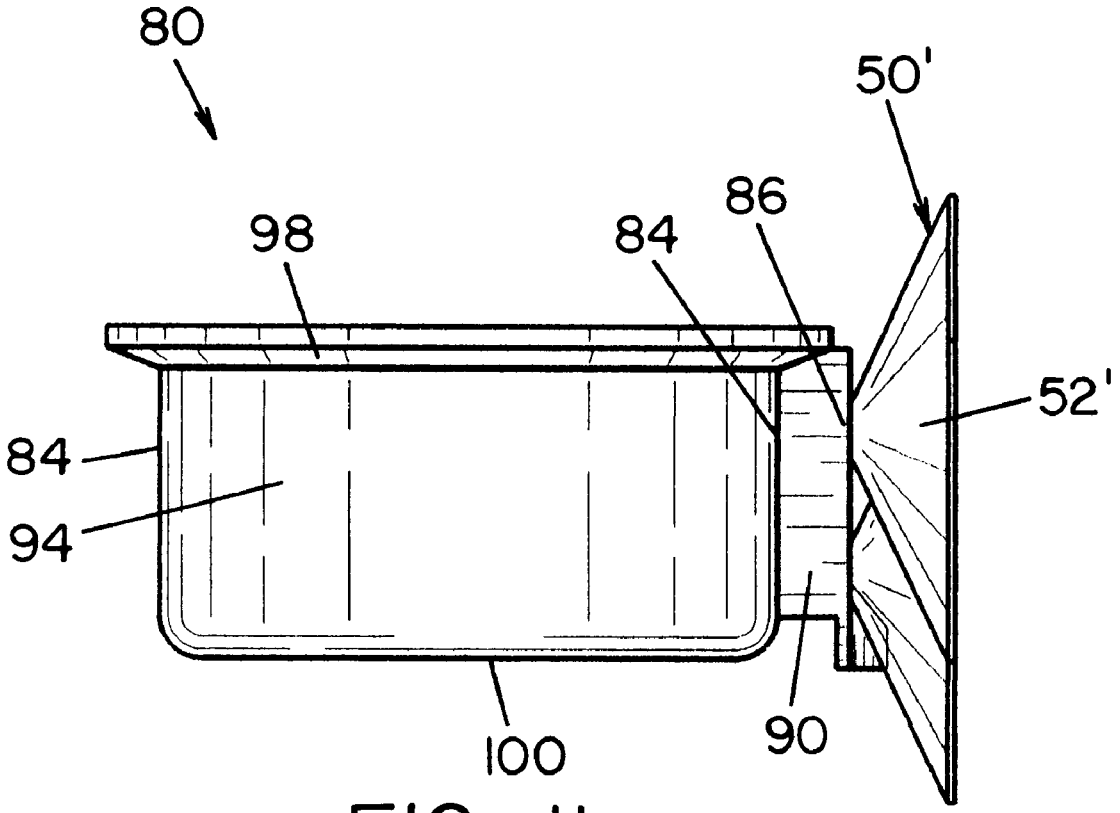
FIG. 11 is a side plan view of the tray shown in FIG. 8.

Engagement wall 86, as best seen in FIG. 10, is a generally planar wall arranged adjacent and generally parallel to rear side wall 84. Holes 88 are formed in engagement wall 86 to receive head 56' of suction cups 50'. Connecting member 90 connects engagement 86 with rear side wall 84.

Floor 100 includes a plurality of drainage apertures 102 and a plurality of dimples 104. Drainage apertures 102 provide an opening for the drainage of fluid from the interior of tray 80. Dimples 104 provide a friction surface for floor 100.

Front side wall 82, rear side wall 84, end walls 94 and floor 100 define a chamber 108. Chamber 108 preferably has a height of approximately 2 inches, a maximum length of approximately 15 inches, and a maximum width of approximately 3½ inches. The dimensions of chamber 108 are best suited for the storage of toiletry items, such as shampoo bottles, conditioner bottles, sponges and soap.

Tray 80 is mountable to a generally vertical surface by engaging suction cups 50 with holes 88 in engagement wall 86. Suction cups 50' are then placed adjacent to the vertical surface and an appropriate pressure is applied thereto by pressing suction cups 50' against the surface.

The preferred dimensions of tray 80 will now be described. Front side wall 82 and rear side wall 84 preferably have a width of approximately 10½ inches and a height of approximately 2 inches (including the height of lip 98); and end walls 94 have a width of approximately 4 inches and a height of approximately 2 inches (including lip 98); engagement wall 86 has a width of approximately 10¾ inches and a height of approximately 2 inches. The approximate interior volume of chamber 108 is 84 cubic inches. The total weight of tray 80 (excluding suction cups 50) is approximately 8.0 ounces. Tray 80 is preferably constructed of plastic.

Referring now to FIGS. 12–15, there is shown a second tray 110 particularly suitable for use as a shower and tub organizer, for storing items such as shampoo, conditioner, shaving cream, toothbrushes, razors and soap. Tray 110 is generally comprised of two side chambers 148 and a center chamber 143. Side chambers 148 are defined by front side wall portions 112, rear side wall portions 114, end walls 124, center walls 130, and floors 132. End walls 124 are generally U-shaped, and connect front side wall portions 112 with rear side wall portions 114. Center walls 130 are generally transverse to front side wall portions 112 and rear side wall portions 114, and connect side wall portions 112 and 114 with each other. Furthermore, center walls 130 define a center chamber 143, which will be described in detail below. Floors 132 include a plurality of drainage apertures 134 and dimples 136. Drainage apertures 134 provide openings for the drainage of fluid from the interior of side chambers 148. Dimples 136 provide a high friction surface.

Center chamber 143 includes an upper horizontal wall 138 and a U-shaped wall 142. Upper horizontal wall 138 includes a plurality of holes 140. Holes 140 are preferably dimensioned to receive the handle end of a toothbrush or razor. U-shaped wall 142 includes a plurality of slots 144 for drainage of fluid from center chamber 143. The portion of center chamber 143 defined by U-shaped wall 142 is preferably dimensioned to receive a bar of soap.

Figure 12:
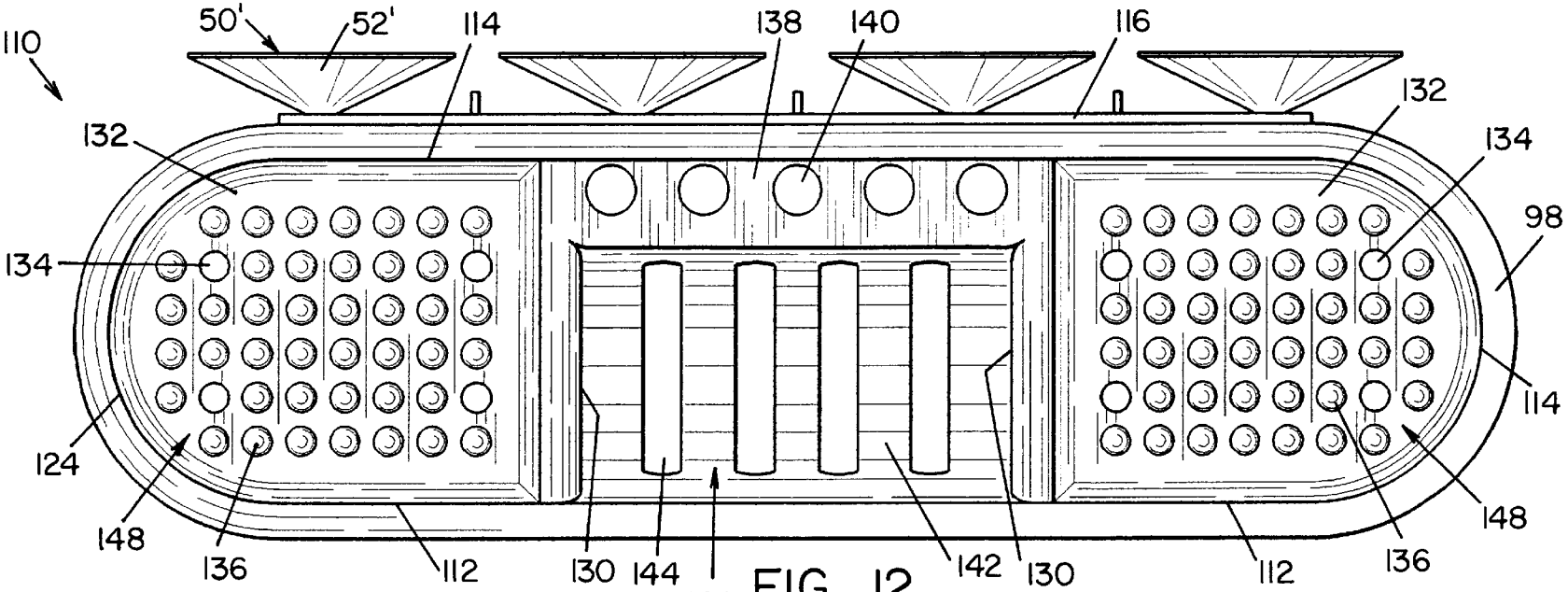
FIG. 12 is a top plan view of a second tray illustrating another preferred embodiment of the present invention.
Figure 13:
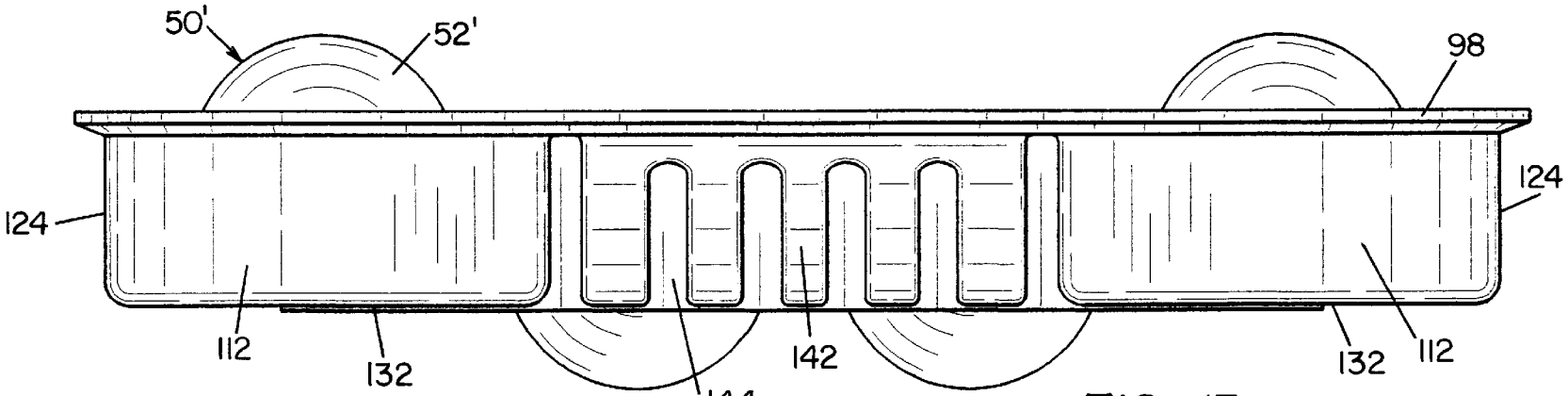
FIG. 13 is a front plan view of the tray shown in FIG. 12.

It should be appreciated that a lip 128 extends around the outer edge of chambers 148 and 143, as best seen in FIGS. 12 and 13.

Figure 14:
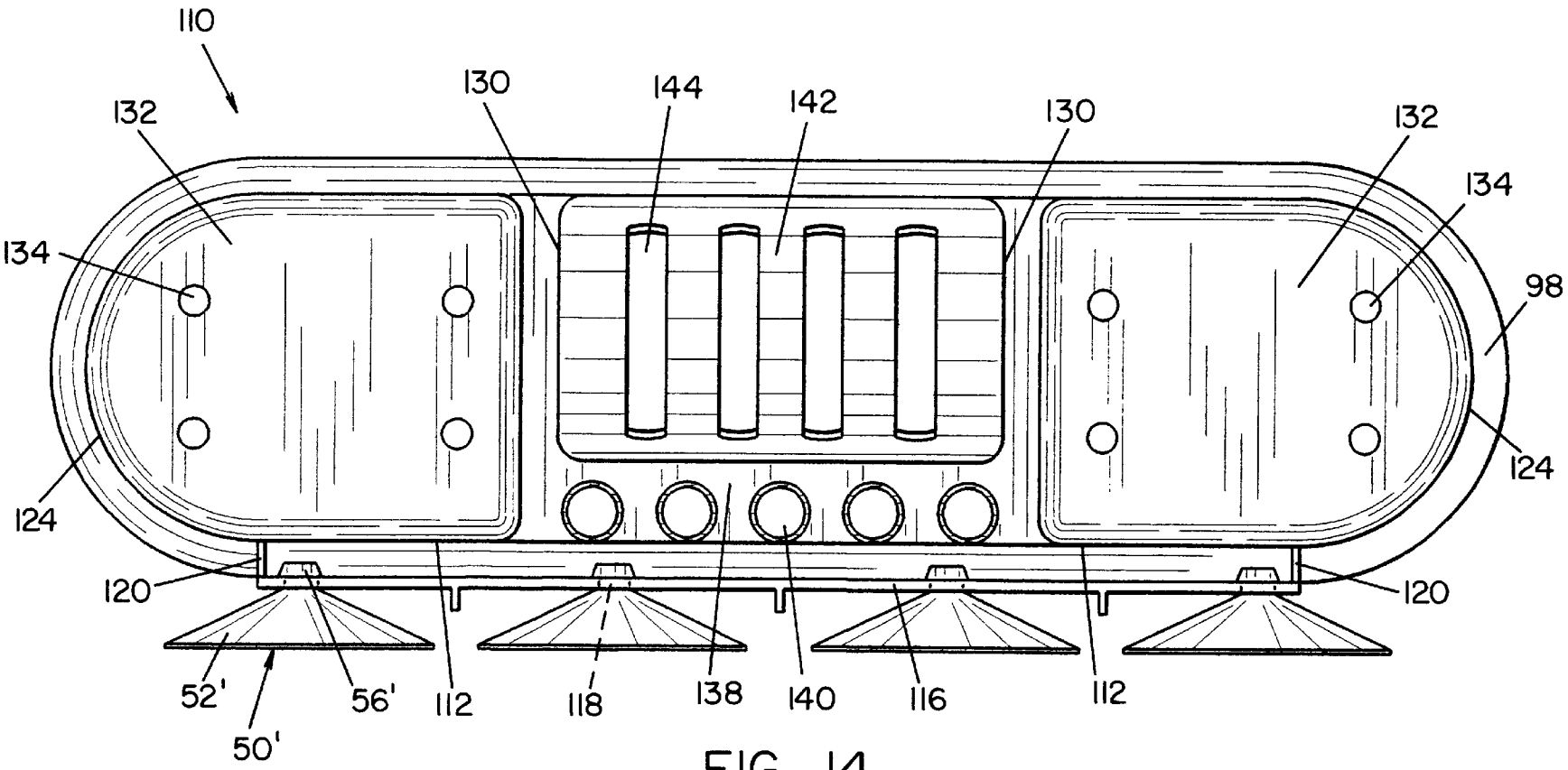
FIG. 14 is a bottom plan view of the tray shown in FIG. 12.
Figure 15:
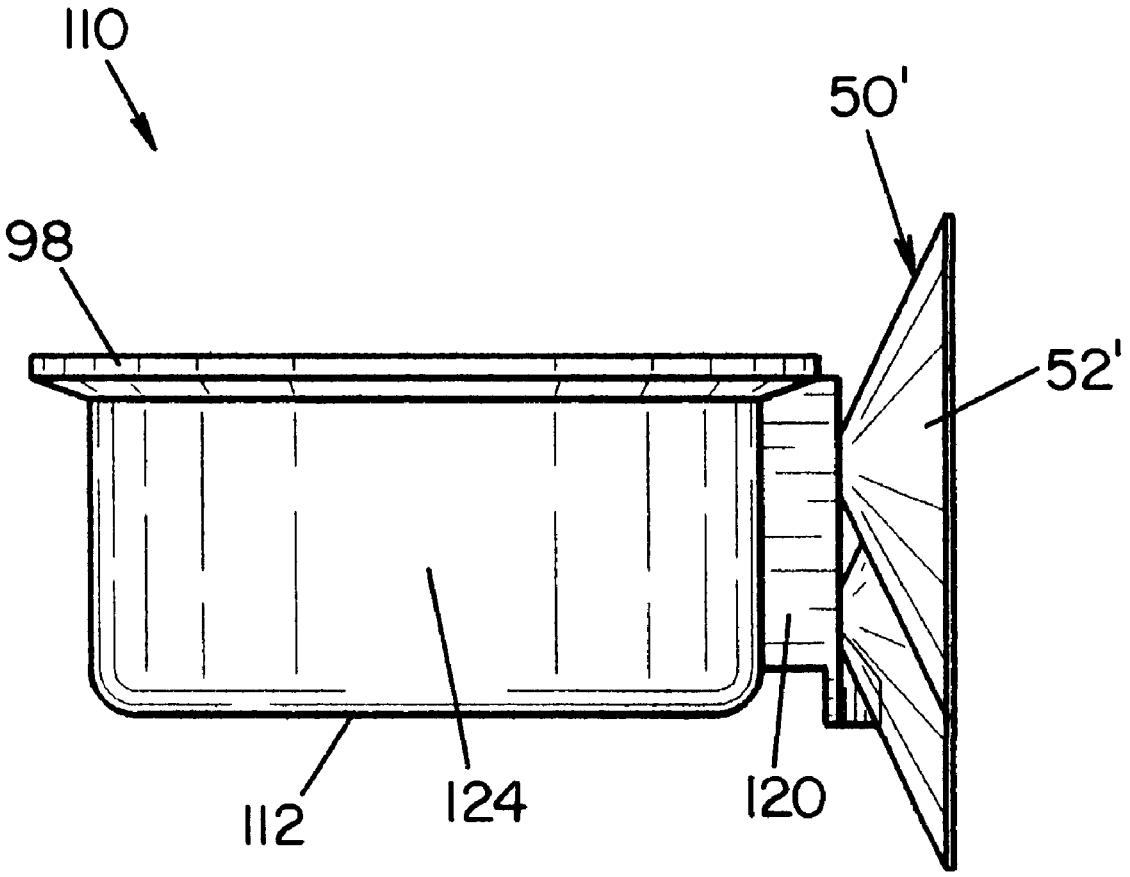
FIG. 15 is a side plan view of the tray shown in FIG. 12.

An engagement wall 116 is arranged adjacent and generally parallel to rear side wall portions 114 (see FIG. 14). Engagement wall 116 has a generally planar surface and includes holes 118 which are dimensioned to receive head 56' of suction cup 50'. Engagement wall 116 has a preferred width of approximately 10¾ inches and a preferred height of approximately 2 inches. A connecting member 120, as best seen in FIGS. 14 and 15, connects engagement wall 116 with rear side wall portions 114.

Tray 110 is mountable to a generally vertical surface in the same manner as tray 80.

Side chambers 148 are preferably 4½ inches by approximately 3½ inches, and has a depth of approximately 2 inches (including lip 128). Center chamber 143 is preferably a length of approximately 4½ inches by approximately 3½ inches, with a maximum depth of approximately 1¾ inches (including lip 128). Tray 110 has a weight of approximately 7.5 ounces and is preferably constructed of plastic.

Figures 16, 17:
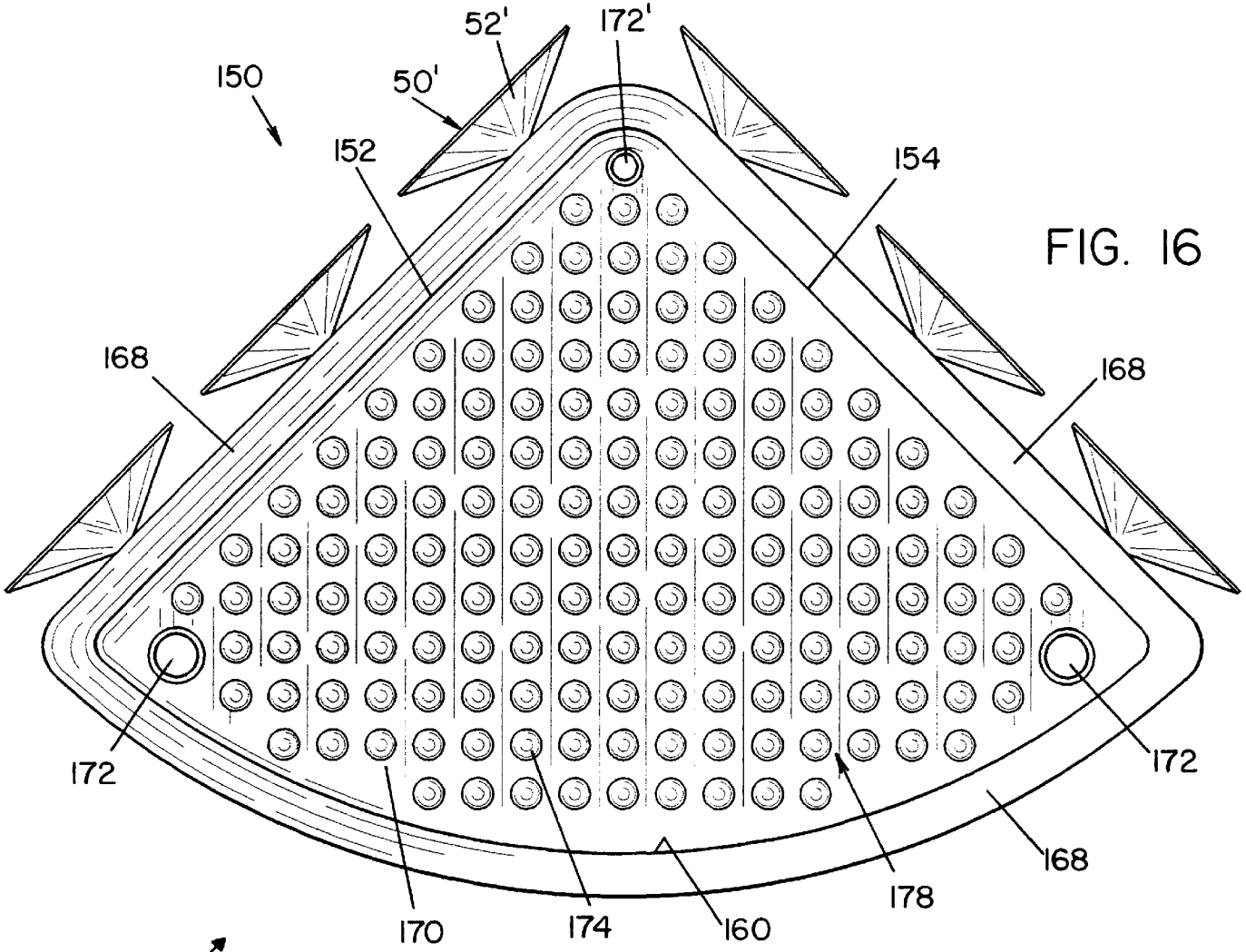
FIG. 16 is a top plan view of a corner shelf illustrating another preferred embodiment of the present invention.
FIG. 17 is a side plan view along the direction of line 17 of FIG. 16.
Figure 17:
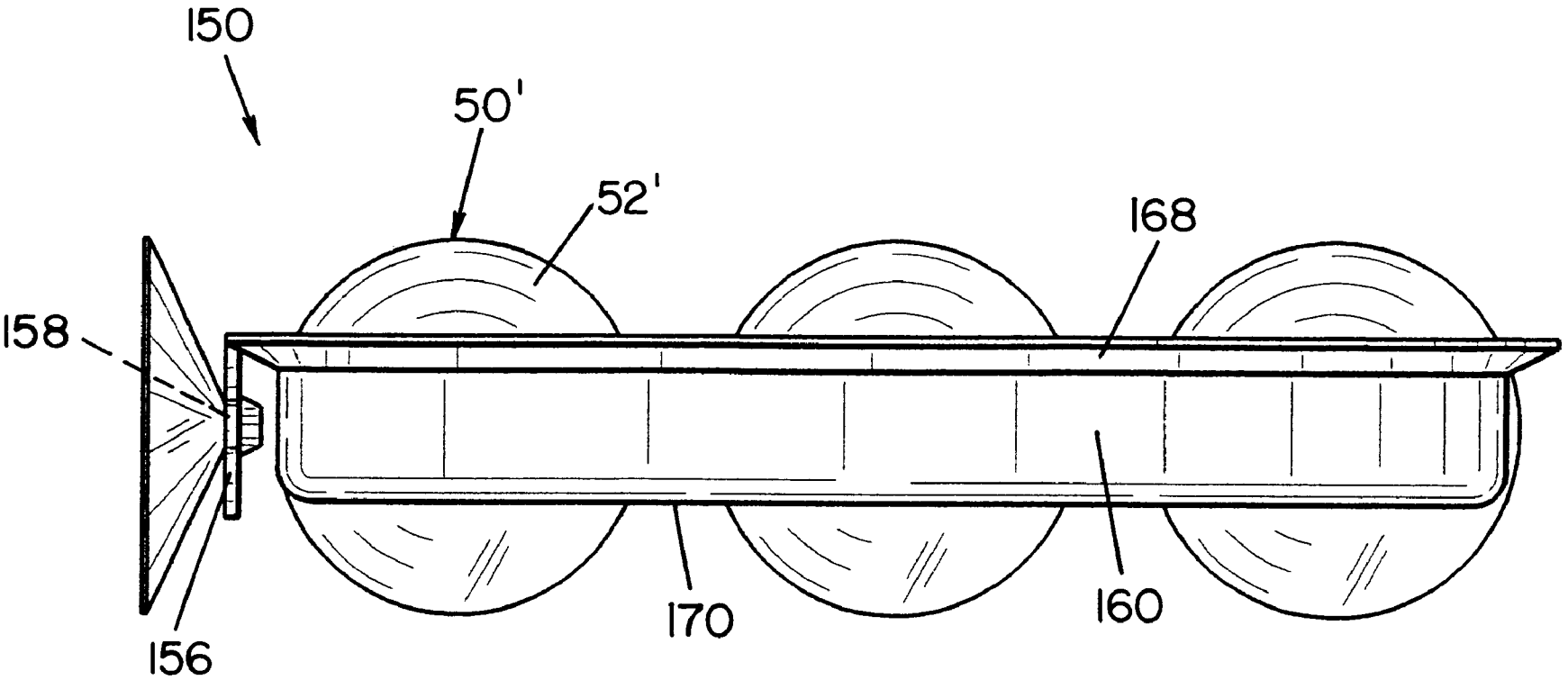
Figure 18:
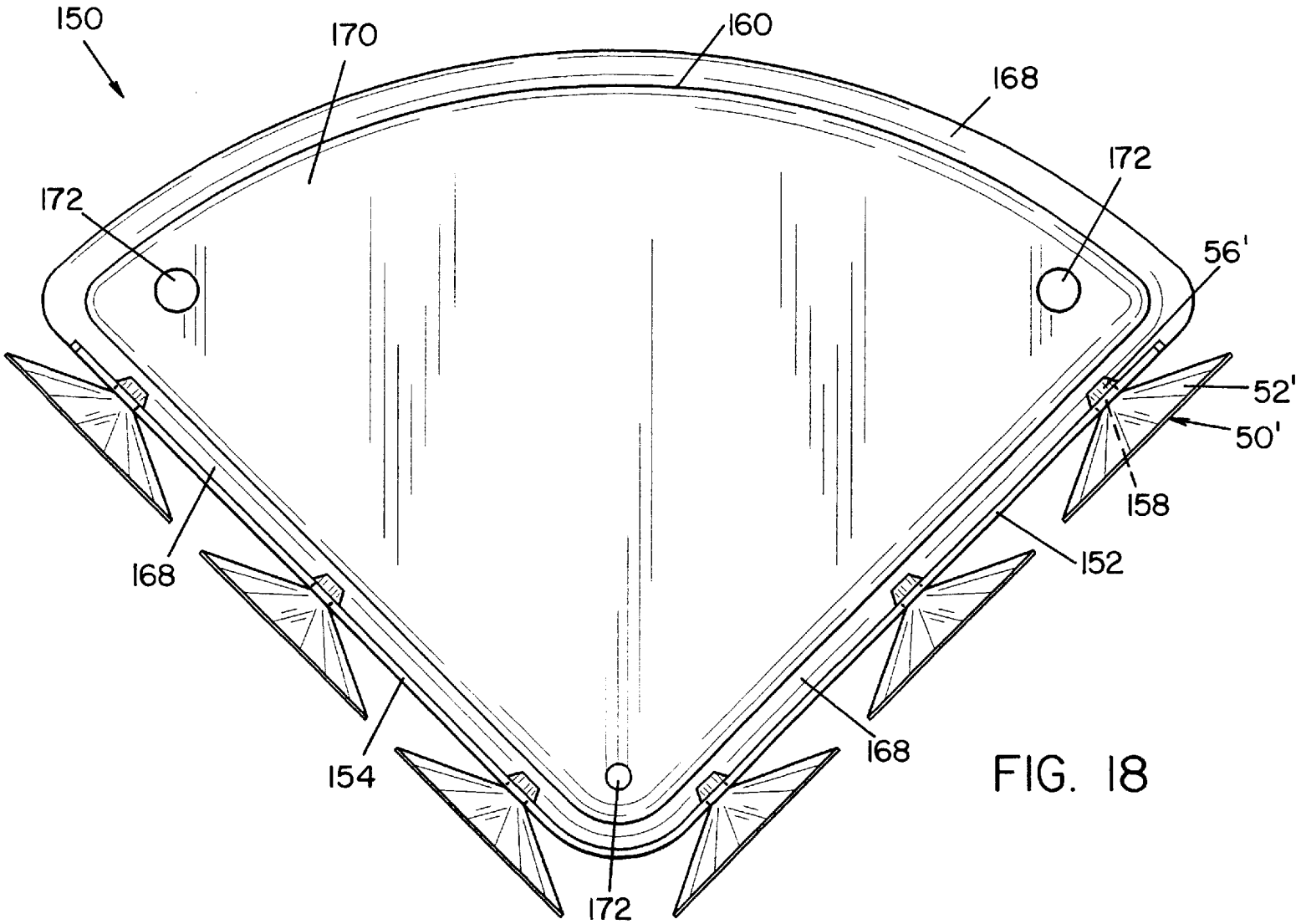
FIG. 18 is a bottom plan view of the corner shelf shown in FIG. 16.
Figure 19:
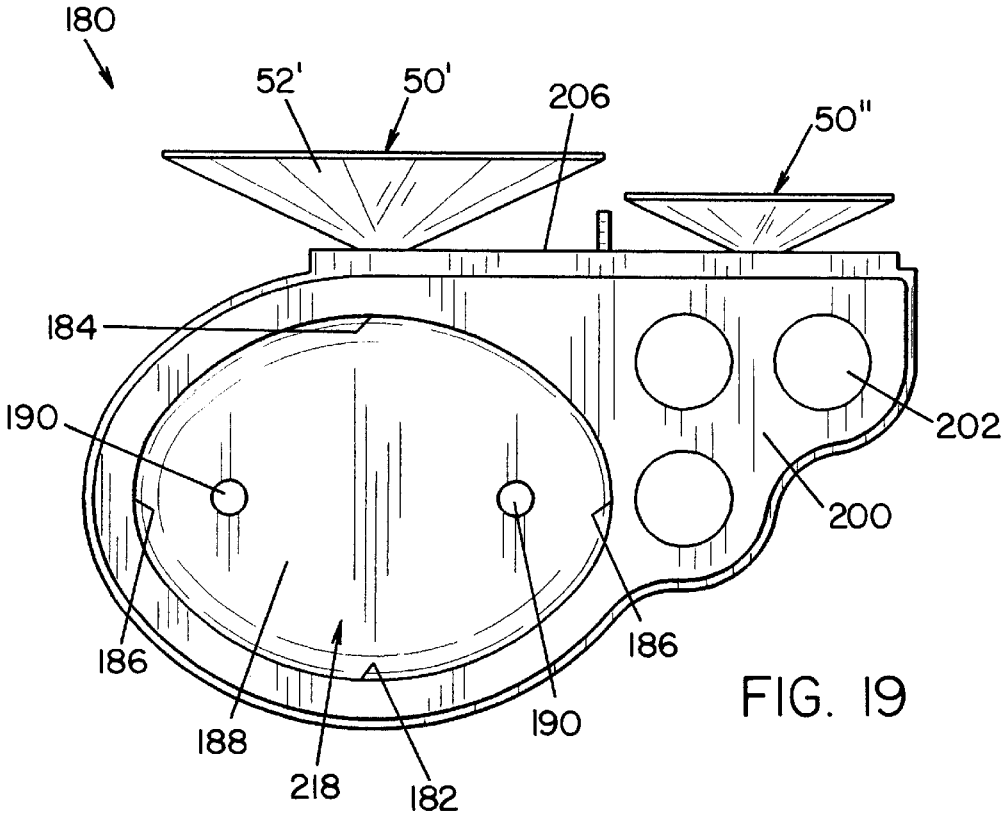
FIG. 19 is a top plan view of a holding member illustrating another preferred embodiment of the present invention.
Figure 20:
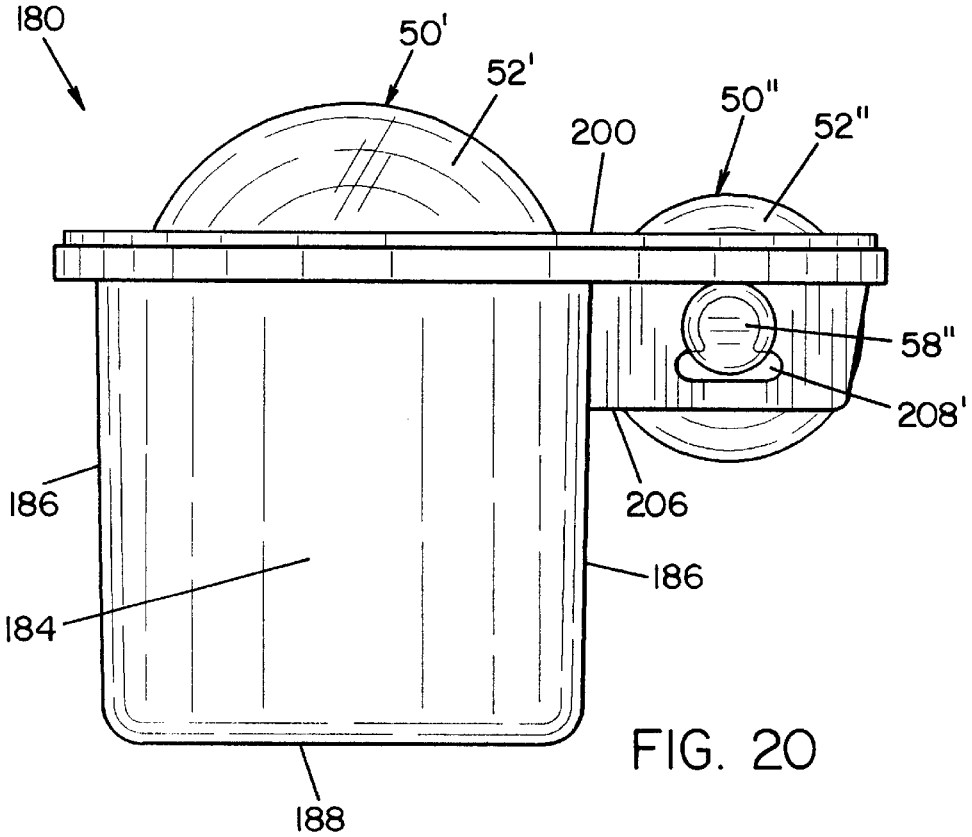
FIG. 20 is a rear side view of the holding member shown in FIG. 19.

Referring now to FIGS. 16–18, there is shown a corner shelf 150, particularly suitable for the storage of items such as shampoo, conditioner, shaving cream, toothpaste and razors. Corner shelf 150 is generally comprised of a first side wall 152, a second side wall 154, engagement walls 156, a front wall 160 and a floor 170. First side wall 152 and second side wall 154 are arranged generally perpendicular to each other as shown in FIGS. 16 and 18. Front wall 160 is a curved wall, and connects first side wall 152 with second side wall 154. A pair of generally planar engagement walls 156 are arranged adjacent and generally parallel to first and second walls 152 and 154, as best seen in FIG. 18. Each engagement wall 156 has three holes dimensioned to receive a suction cup 50'.

A lip 168 is arranged along the perimeter of first side wall 152, second side wall 154 and front wall 160. Engagement walls 156 are integrally attached to lip 168, as shown in FIG. 18.

First side wall 152, second side wall 154, front wall 160 and floor 170 define a chamber 178. Floor 170 includes drainage apertures 172 and 172', as well as dimples 174. Drainage apertures 172 and 172' provide a means for draining fluid from the interior of chamber 178. It should be appreciated that drainage aperture 172 may also be dimensioned to receive the handle end of a razor for storage of the razor inside chamber 178. In this respect, drainage apertures 172 may have a larger diameter than drainage aperture 172'. Dimples 174 provide a high friction surface.

Corner shelf 150 is mountable to a pair of generally perpendicular vertical surfaces using suction cups 50'. Accordingly, corner shelf 150 is arrangeable within a corner area formed by the two generally perpendicular vertical surfaces.

Side walls 168 and engagement walls 156 preferably have a width of approximately 9 inches. Curved front wall 160 has a height of approximately 1½ inches (including lip 168) and is along a radius of curvature of approximately 9 inches. Side walls 168 and 169 and curved front wall 160 preferably have a height of approximately 1½ inches (including lip 168). Corner shelf 150 preferably has a weight of approximately 8 ounces (without suction cups 50'). Corner shelf 150 is preferably constructed of plastic.

Referring now to FIGS. 19–22, there is shown a holder 180 particularly well suited for storage of items such as toothpaste and toothbrushes. Holder 180 is generally comprised of a front side wall 182, a rear side wall 184, end walls 186, floor 188 and an extension portion 200. Front side wall 182, rear side wall 184, end walls 186 and floor 188 define an oval-shaped chamber 218. Front side wall 182 and rear side wall 184 are curved walls which are connected to each other by end walls 186. Floor 188 includes holes 190 for draining fluid from chamber 218.

Figure 21:
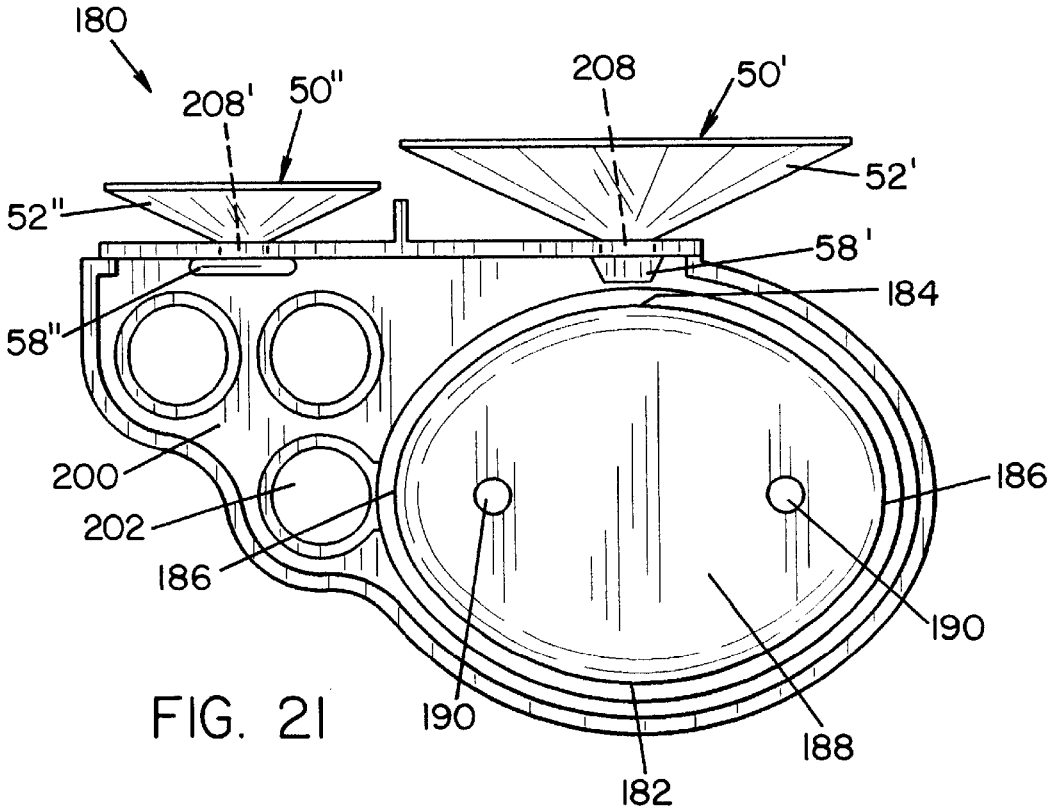
FIG. 21 is a bottom plan view of the holding member shown in FIG. 19.
Figure 22:
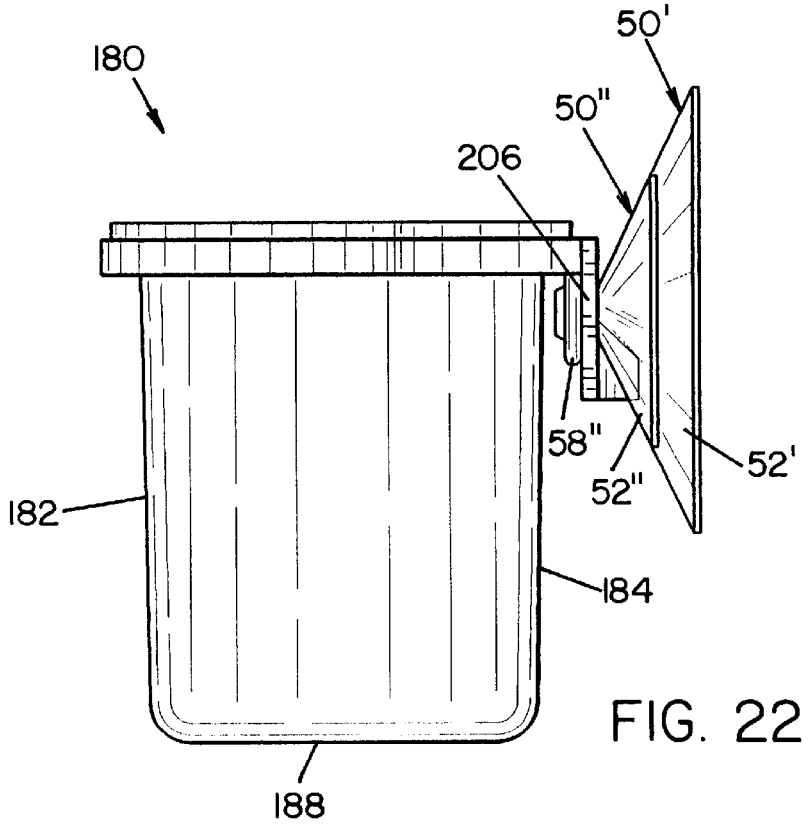
FIG. 22 is a side view of the holding member shown in FIG. 19.

A generally planar horizontal extension portion 200 extends from the upper perimeter of walls 182, 184 and 186. Extension portion 200 includes holes 202, which are preferably dimensioned to receive the handle end of a toothbrush. A generally planar engagement wall 206 attaches to extension portion 200, as best seen in FIG. 21. Openings 208 and 208' are formed in engagement wall 106. Openings 208 and 208' are dimensioned to receive, respectively, suction cups 50' and 50".

It should be appreciated that suction cup 50" is a modified version of suction cup 50'. In this respect, suction cup 50" has a diameter of approximately 1¾ inches and an enlarged locking portion 58". The widest portion of opening 208' (see FIG. 20) is dimensioned to receive locking portion 58" therethrough.

Holder 180 is mountable to a generally vertical surface using suction cups 50' and 50".

Chamber 218 preferably has a height of approximately 3 inches, a maximum length of 3 inches, and a maximum width of approximately 2¼ inches. Furthermore, holder 180 has a weight of approximately 2.5 ounces. Holder 180 is preferably constructed of plastic.

The foregoing description is directed to specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A basket assembly comprising:

a floor section having a generally oblong shape, and including a set of drain holes, parallel, opposed sides with opposed ends, and curved end sections connecting the opposed ends;

parallel side walls integral with the floor section and extending vertically upwardly from the parallel opposed sides of the floor section and perpendicular to the floor section, one of said side walls having spaced apart suction cup receiving holes extending through one of said side walls, and the other of said side walls having surfaces defining a set of holes extending through the other of said side walls;

opposed, curved solid end walls integral with the floor section and with the side walls, and extending vertically upwardly from the curved end sections of the floor section and perpendicular to the floor section; said side walls and said end walls having a height that exceeds the width of said floor section;

a rounded rim portion defining a perimeter around the top of the curved end walls and side walls; and a pair of suction cups having concave portions for engaging a wall, the diameter of said concave portions being at least 2 inches, said suction cups having rounded head portions releasably engagable in the suction cup receiving holes for connecting the suction cups to the one of said side walls, each of said head portions including a rounded locking portion having a diameter greater than the remainder of the head portion, each of said locking portions engagable with the inner surface of one of said side walls for securing the suction cups to the one of said side walls when said head portions are received in said receiving holes.

2. A basket assembly according to claim 1 wherein each of the set of holes are of square configuration.

* * * * *